US007012386B1

(12) United States Patent
Berg et al.

(10) Patent No.: US 7,012,386 B1
(45) Date of Patent: Mar. 14, 2006

(54) ENHANCED RF WINDOW FOR WAVEGUIDE USED WITH PARTICLE ACCELERATOR

(75) Inventors: Steve W. Berg, Villa Park, IL (US); George A. Goeppner, Orland Park, IL (US); Arthur E. Grelick, Barrington, IL (US); John Hoyt, Woodridge, IL (US); Yoon W. Kang, Knoxville, TN (US); Wayne Michalek, Plainfield, IL (US); Terry L. Smith, Plainfield, IL (US); William Yoder, Romeoville, IL (US)

(73) Assignee: The University of Chicago, Chicago, IL (US)

( * ) Notice: Subject to any disclaimer, the term of this patent is extended or adjusted under 35 U.S.C. 154(b) by 0 days.

(21) Appl. No.: 10/971,653

(22) Filed: Oct. 22, 2004

(51) Int. Cl.
*H01J 23/00* (2006.01)

(52) U.S. Cl. ..... 315/505; 315/5.41; 315/506

(58) Field of Classification Search ..... None
See application file for complete search history.

(56) References Cited

U.S. PATENT DOCUMENTS 3,327,159 A * 6/1967 Green ..... 315/5.38
5,084,682 A * 1/1992 Swenson et al. ..... 315/505

OTHER PUBLICATIONS

S. Berg, D. Bromberek, G. Goeppner, A. Haase, J. Hoyt, W. Michalek, T. Smith, "Development of the Low Return Loss 340-Size Ceramic Window for the APS Linac", Proceedings of the 2nd International Workshop on Mechanical Engineering Design of Synchrotron Radiation Equipment and Instrumentation (MEDSI02), Argonne, Illinois, pps. 50-17, Sep. 2002.

A. E. Grelick, S. Berg, G. Goeppner, A. Nassiri, G. Pile, T. Smith, Y. W. Kang, Haase, D. Miller, "Testing and Operation of the WR340 Waveguide Window in the APS LINAC," Proceedings of the LINAC2002, Gyeongju, Korea, pp. 713-715, 2002.

A. E. Grelick, N. Arnold, S. Berg, D. Dohan, G. Goeppner, Y. W. Kang, A. Nassiri, S. Pasky, G. Pile, T. Smith, S. J. Stein, "Testing and Implementation Progress on the Advanced Photon Source (APS) Linear Accelerator (LINAC) High Power S-Band Switching System," Proceedings of the XX International Linac Conference, Monterey, CA, pp. 983-985, 2000.

* cited by examiner

*Primary Examiner*—David Vu
(74) *Attorney, Agent, or Firm*—Joan Pennington

(57) ABSTRACT

An RF window and a method of manufacture of the RF window are provided. The RF window of the invention has very low reflected RF power. The RF window includes a center sleeve assembly including a ceramic disc mounted within a copper sleeve. The ceramic disc has opposed surfaces, a ceramic surface coating is applied to each of the opposed surfaces. The ceramic surface coatings are selected for a particular application of the RF window. A pair of end assemblies is removably assembled with the center sleeve assembly. An end assembly mating face is arranged for adjustable slip fit engagement within the copper sleeve of the center sleeve assembly to define a respective cavity on opposed sides of the ceramic disc with the mating face positioned at an adjusted position. An intermediary ring is fixedly secured to the end assembly with the mating face at the adjusted position.

19 Claims, 8 Drawing Sheets

ENHANCED RF WINDOW FOR WAVEGUIDE USED WITH PARTICLE ACCELERATOR

The United States Government has rights in this invention pursuant to Contract No. W-31-109-ENG-38 between the United States Government and Argonne National Laboratory.

FIELD OF THE INVENTION

The present invention relates to a radio frequency (RF) window for use in a particle accelerator; and more specifically relates to an improved design and method of manufacture for an RF window for use with a particle accelerator in a waveguide, with the RF window having very low reflected RF power.

DESCRIPTION OF THE RELATED ART

Hollow waveguides are conduits made of metal, usually round or rectangular in cross-section, capable of confining and supporting RF energy to a specific relatively narrow and controllable path. The dimensions of the waveguide vary according to the frequency of the RF energy used, as determined by a particular application.

Often and for particle accelerator applications, a very high vacuum is drawn on the waveguide in order to support very high electric field strengths, that is a very high density of RF energy, to increase the peak power handling capability. Occasionally, if vacuum can not be maintained, it is desirable for the waveguide to contain a quantity of pressurized gas in order to support certain components such as RF switches or circulators that require this gas to function as an insulator with higher breakdown voltage.

RF windows are components set into waveguides to separate a section of the waveguide operating under a vacuum from a second section of waveguide containing another evacuated volume or pressurized gas. An RF window typically consists of a thin ceramic solid cylinder or disc with low RF loss, and the associated hardware of geometry suitable to insert the ceramic thin solid disc into the waveguide. RF windows need to have very low reflected RF power, also known as RF power return loss, and are applicable to a specific signal frequency range of interest, where very low RF power return loss, for example, has a magnitude greater than 40 dB, which means that less than $1/10{,}000$ of the incident power is reflected.

The RF windows must be designed to maintain an abrupt transition from very high vacuum on one side of the thin solid disc to a positive pressure above atmospheric on the other side of the relatively thin ceramic solid disc. The task associated with RF window fabrication is to do this in such a manner as to reduce as much as possible any loss or reflected RF energy from the RF signal that is being transmitted through the waveguide.

RF windows are commercially available in what has been designated by the Electronic Industries Association as WR284 size, supporting RF energy over the frequency range of 2.60 to 3.95 GHz. High quality RF windows of this size have a RF power return loss ranging from $1/630$ to $1/1600$, which is approximately between 28 dB and 32 dB. For demanding installations, such as for particle accelerators, preferably the RF power return loss would be even less, and as well the power loss due to length of long waveguide runs would preferably be reduced.

Particle accelerator designers have changed the waveguide size to WR340, supporting RF energy over a lower frequency range of 2.20 to 3.30 GHz, specifically to decrease the power loss through the waveguide runs, because power loss per unit length of the WR340 size waveguide is less than the power loss per unit length of the WR284 size waveguide.

There is thus the need for WR340 size RF windows, and none have been commercially available in this size. It is highly desirable is to fabricate a vacuum tight WR340 size RF window with RF power return loss better than 32 dB.

Principal aspects of the present invention are to provide an improved design and method of manufacture for an RF window for use with a particle accelerator in a waveguide having very low reflected RF power.

Other important aspects of the present invention are to provide such improved design and method of manufacture for an RF window substantially without negative effect and that overcome many of the disadvantages of prior art arrangements.

SUMMARY OF THE INVENTION

In brief, an RF window and a method of manufacture of the RF window are provided. The RF window of the invention has very low reflected RF power. The RF window includes a center sleeve assembly including a ceramic disc mounted within a copper sleeve. The ceramic disc has opposed surfaces, a ceramic surface coating is applied to each of the opposed surfaces. The ceramic surface coatings are selected for a particular application of the RF window. A pair of end assemblies is removably assembled with the center sleeve assembly. Each end assembly includes an adjustable plunger end assembly. The adjustable plunger end assembly includes an intermediary ring for removable assembly with the center sleeve assembly and a mating face. The mating face is arranged for adjustable slip fit engagement within the copper sleeve of the center sleeve assembly to define a respective cavity on opposed sides of the ceramic disc with the mating face positioned at an adjusted position. The intermediary ring is fixedly secured to the end assembly with the mating face at the adjusted position.

In accordance with features of the invention, each end assembly includes an end conflat. The center sleeve assembly includes a support ring fixedly secured to the copper sleeve. A pair of opposed conflats is fixedly secured to the support ring to complete the center sleeve assembly. The end assemblies are removably assembled using bolts to removably connect the respective conflats of the end assemblies to the opposed center sleeve assembly conflats. During assembly, RF bench testing to fine tune each respective cavity size is performed.

In accordance with features of the invention, the center sleeve assembly is detached from the end assemblies to expose the ceramic disc. Then the ceramic surface coatings are serviced, after the RF window has been subjected to a high power level. Alternatively, another ceramic surface coating material is applied to one or both of the opposed surfaces of the ceramic disc.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the present invention, a new design and process of manufacture are provided for a WR340 size RF window having a RF power return loss equal to or better than 40 dB. The process of the invention makes possible investigating the design of other size RF windows also with improved RF power return loss for a specific signal frequency, for example improving the WR284 size RF windows from 32 dB RF power return loss to better than 40 dB RF power return loss at 2856 MHz.

Figure 1:
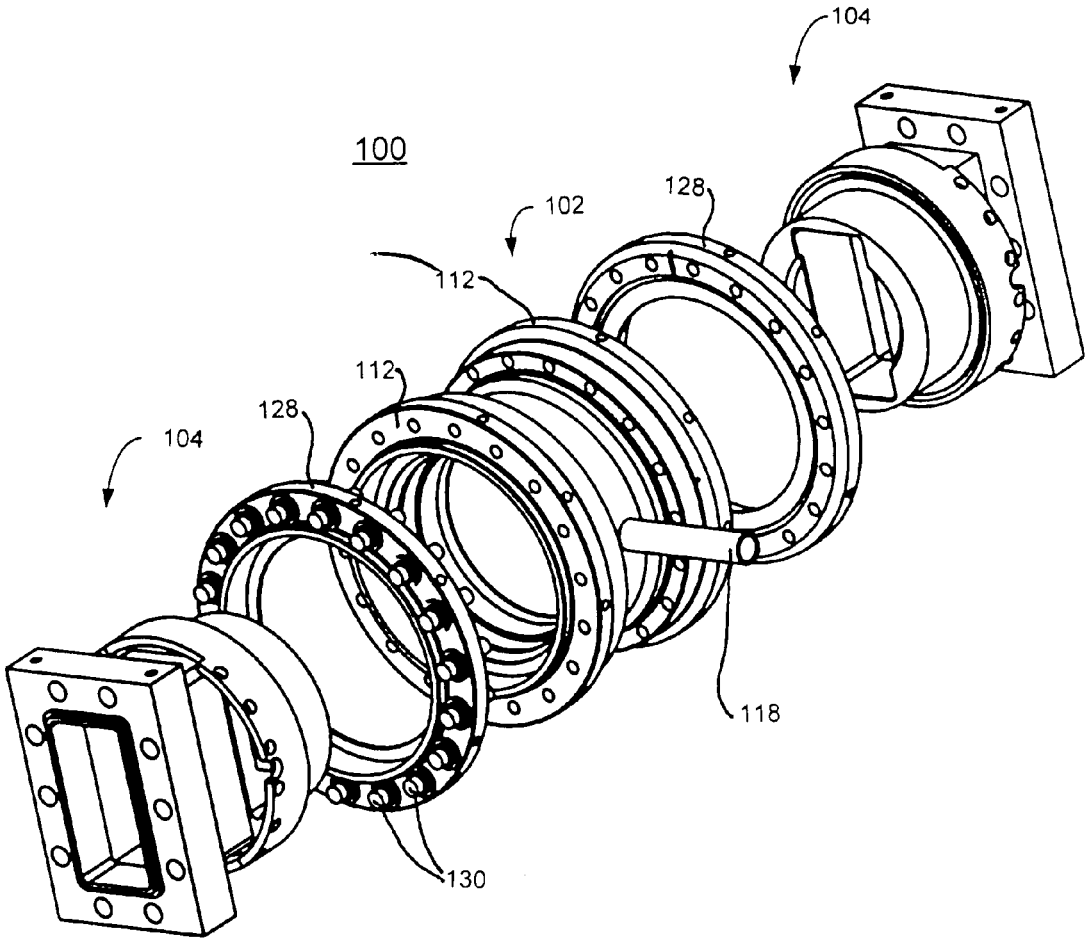
FIG. 1 is an exploded perspective view of the RF window in accordance with the preferred embodiment.
Figure 2:
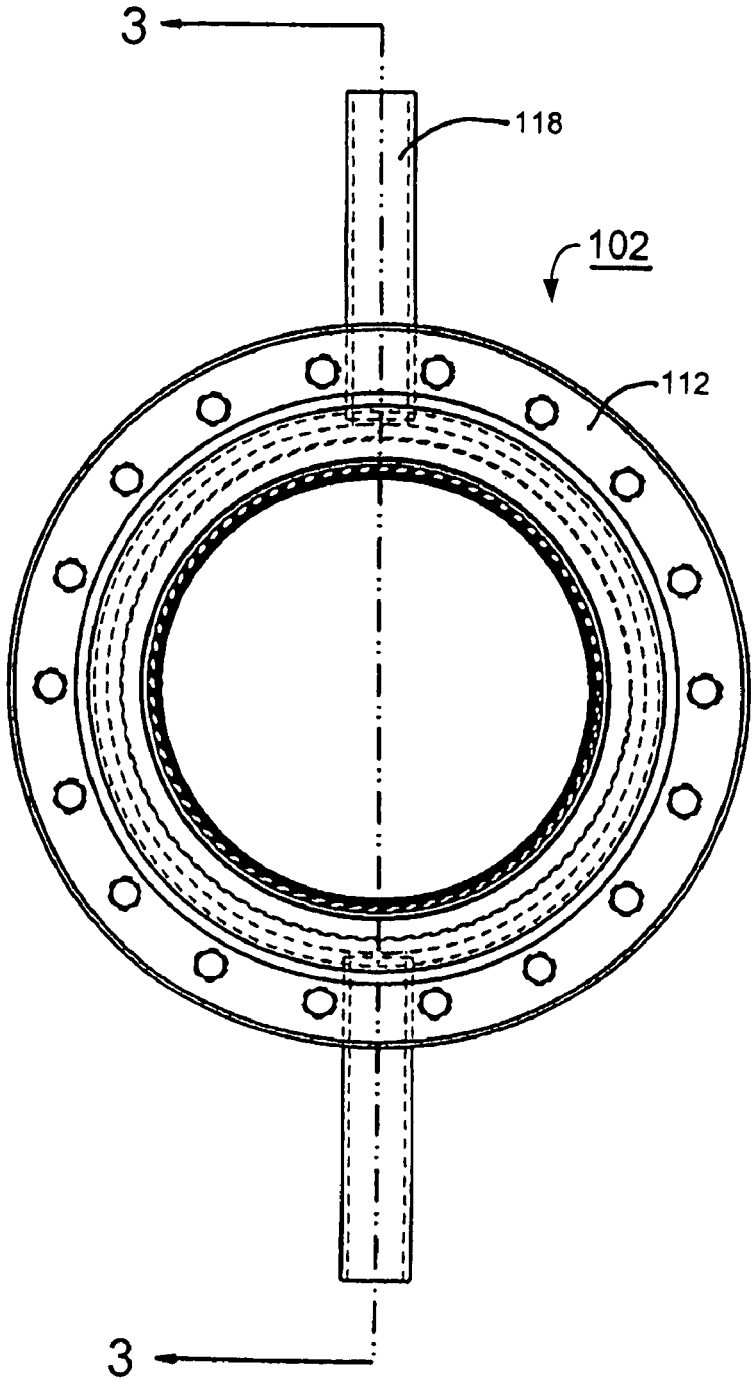
FIG. 2 is a detailed end view of a demountable center sleeve assembly of the RF window of FIG. 1 in accordance with the preferred embodiment.
Figure 3:
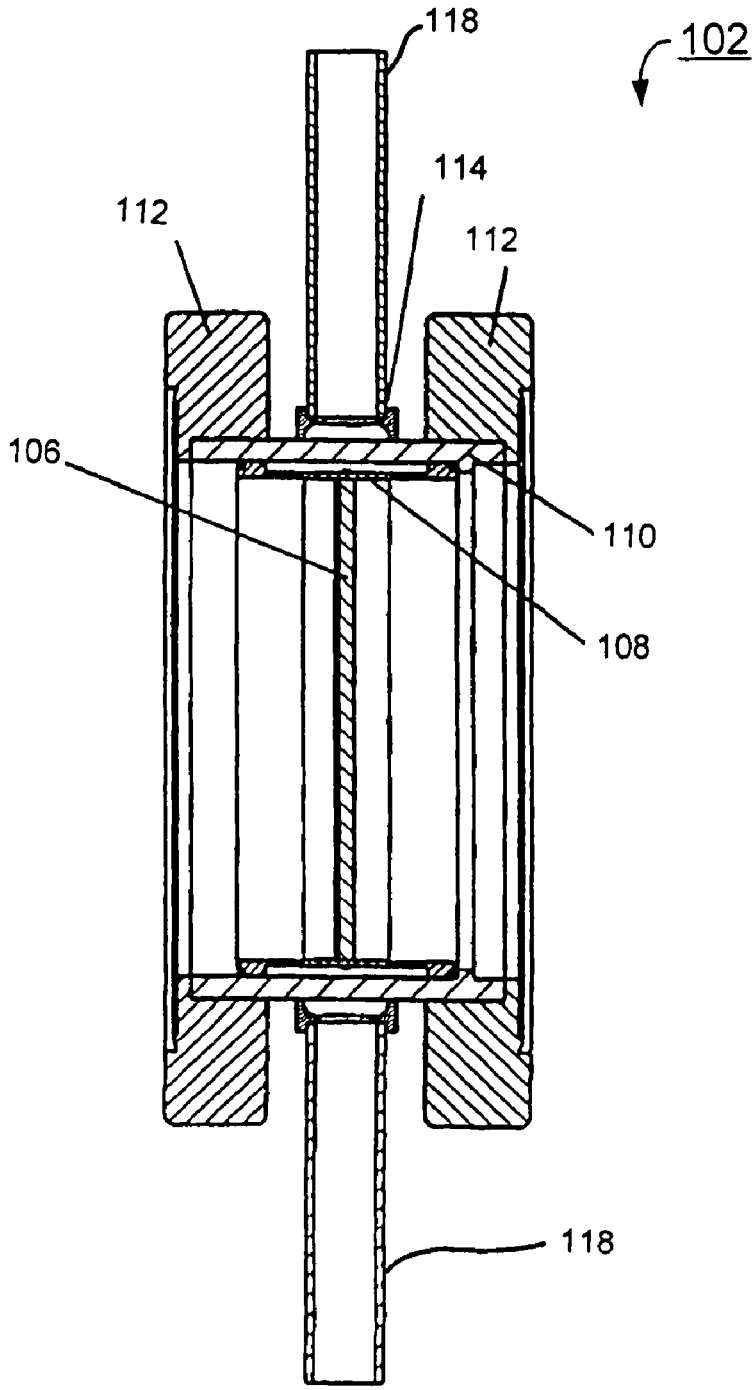
FIG. 3 is a detailed sectional view taken along the line 3—3 of the demountable center sleeve assembly of FIG. 2 in accordance with the preferred embodiment.
Figure 4:
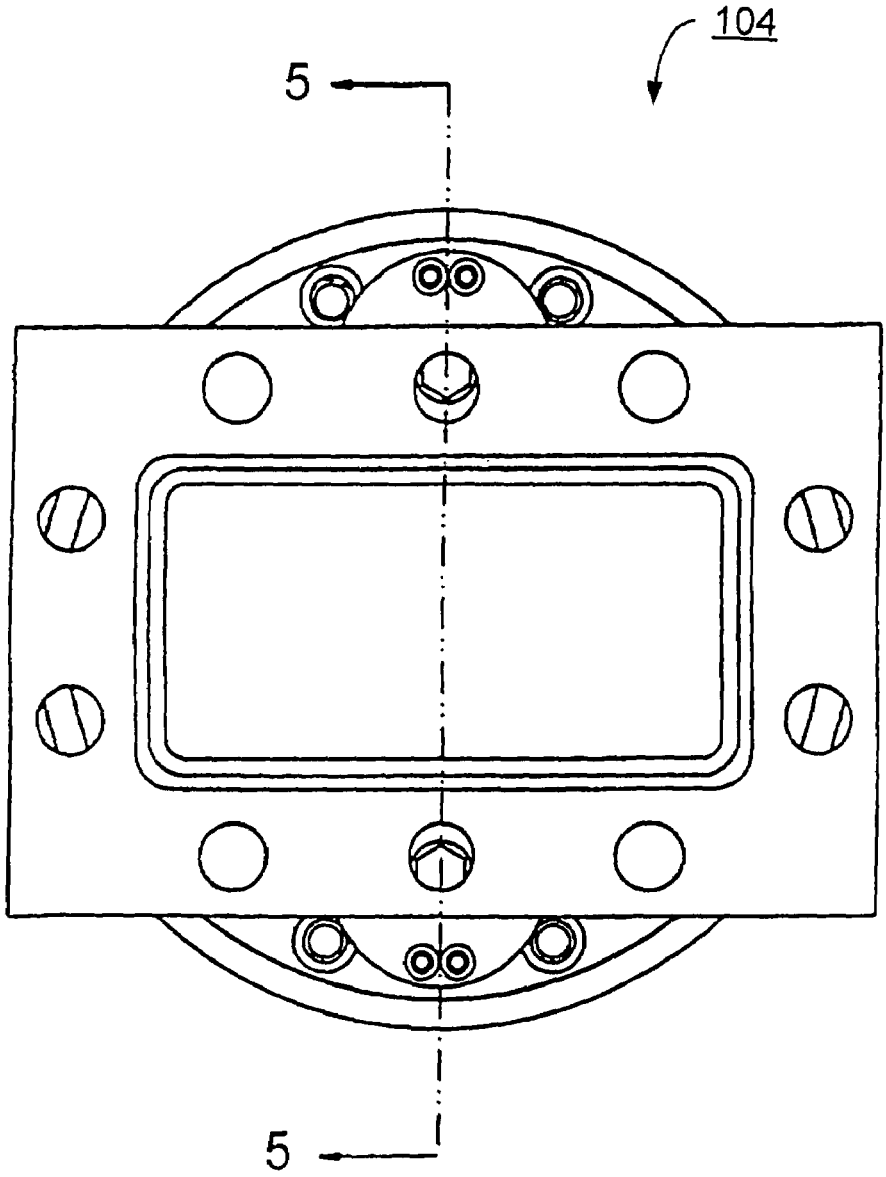
FIG. 4 is a detailed end view of an adjustable plunger end and cavity tuner assembly of the RF window of FIG. 1 in accordance with the preferred embodiment.
Figure 5:
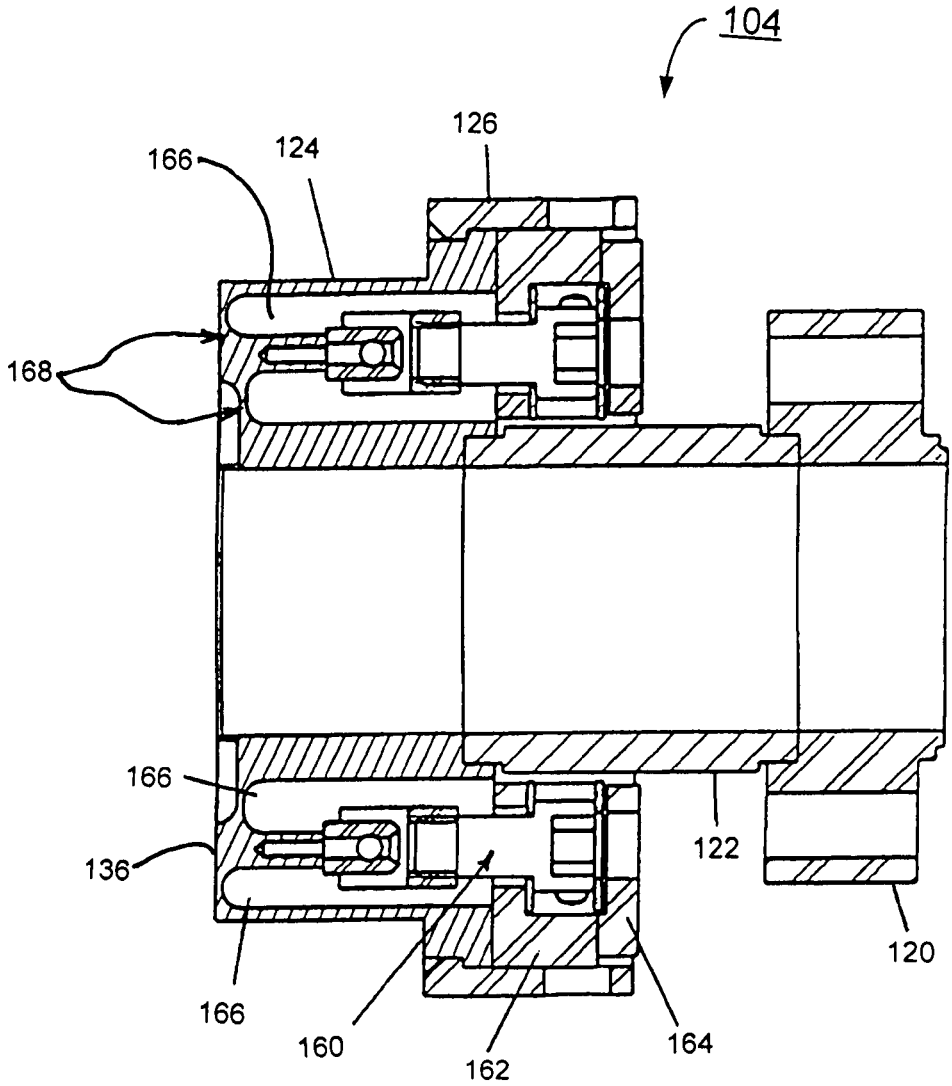
FIG. 5 is a detailed sectional view taken along the line 5—5 of the adjustable plunger end and cavity tuner assembly of FIG. 4 in accordance with the preferred embodiment.

Having reference now to the drawings, in FIG. 1, there is shown a RF window generally designated by the reference character 100 in accordance with the preferred embodiment. RF window 100 includes a demountable center sleeve assembly generally designated by reference character 102 in accordance with the preferred embodiment. The demountable center sleeve assembly 102 is illustrated in detail in FIGS. 2, 3 and 6. RF window 100 includes a pair of adjustable plunger end and cavity tuner assemblies generally designated by reference character 104 in accordance with the preferred embodiment. The adjustable plunger end and cavity tuner assemblies 104 are illustrated in detail in FIGS. 4, 5, and 6.

In accordance with features of the present invention, the center sleeve assembly 102 and adjustable plunger end and cavity tuner assemblies 104 cooperate together to allow for fine adjustment of the cavity size. After the RF window 100 has been subjected to a high power level, the center sleeve assembly 102 is detached from the end assemblies 104 to expose a ceramic disc and then ceramic surface coatings are serviced or new ceramic surface coatings are applied. The adjustable plunger end and cavity tuner assemblies 104 provide finely adjustable cavity tuner features to optimize assembly dimensions through feedback from reflected power measurements. A pair of tuning screws in each of the assemblies 104 enables fine adjustments of the cavity dimensions following final vacuum tight (VT) assembly to improve reflected power characteristics of the RF window 100. Copper construction of the RF cavity is enabled while also allowing for vacuum tight TIG weld toward VT assembly of the RF window 100.

In accordance with features of the present invention, the RF window 100 has very low reflected RF power. After completion of manufacturing process, a conventional fixed cavity design with no tunability in the window cannot provide the desired minimum RF reflection. The present invention with the structure of the RF window 100 that employs fine tuning mechanisms can be used for building similar windows for various frequencies in various waveguide sizes by applying proper scaling.

Referring also to FIGS. 2, 3, 6 and 7, the center sleeve assembly 100 includes a horizontal ceramic thin solid cylinder 106 or ceramic disc 106 is set into the center of center sleeve assembly 100. The ceramic disc 106 has been fixedly secured, for example, vacuum tight (VT) furnace brazed to a thin walled copper sleeve 108 whereby the VT furnace braze is a permanent bond between two metallic surfaces, being either or both copper or stainless steel. This VT furnace braze has subjected the copper sleeve 108 to an annealing process. A successful VT furnace braze between the ceramic disc 106 and the copper sleeve 108 traditionally requires the ceramic disc edge to be metalized and also requires the walls of the copper sleeve to be thin. These thin walls later present a problem in control of dimension, for instance in control of inner diameter of the copper sleeve 108. The thin walled copper sleeve 108 is thus reinforced by a stainless steel ring 110; this adequately increases rigidity of the thin walled copper sleeve 108 during machining, and allows the copper sleeve to retain its roundness following the annealing process.

Ceramic materials used for the ceramic disc 106 in RF window 100 have dielectric permittivities many times greater than that of vacuum or air. The ceramic disc 106 is formed, for example, of aluminum oxide, or alumina as a ceramic material and coated, for example, with Titanium Nitride ($TiN_2$) or a selected one of various other possible ceramic surface coating materials having a low secondary electron emission coefficient. For example, the relative permittivity of Alumina ceramic $\epsilon_r$=9.8 as compared to $\epsilon_r$=1 for that of air or vacuum. Introduction of such dense material in a waveguide can cause RF impedance mismatch that results considerable reflection if not properly corrected.

The demountable center sleeve assembly 102 thereby consists of the ceramic disc 106 VT furnace brazed to the thin walled copper sleeve 108 which is VT furnace brazed to a stainless ring 110, which is in turn welded to one center conflat 112 at each end, giving a total two center conflats 112. Conflats 112 are stainless steel in construction, used in the vacuum industry routinely whereby two bolt together remove-ably with gasket to form a VT joint. The welding being employed throughout is tungsten inert gas (TIG) welding, which is routinely used in the vacuum industry to quickly and easily form permanent VT bonds between stainless steel components. Also shown is a water jacket 114 that is TIG welded to the stainless steel ring 110. This water jacket 114 is used to circulate water around the stainless ring 110 to cool the ceramic disc 106 during high power RF applications, and completes the first sub-assembly of the RF Window 100. The center sleeve assembly 102 includes a pair of pipes 118 coupled to the water jacket 114.

Referring also to FIGS. 4, 5, 6 and 7, the adjustable plunger end assembly 104 comprises a pair of assemblies removably attached to the center sleeve assembly 102 to form the RF Window 100. The two plunger end assemblies 104 and one center sleeve assembly 102 are assembled together to form, for example, a WR340 RF Window. Each of the plunger end assemblies 104 consists of a waveguide flange 120, fixedly secured, for example, VT furnace brazed to a copper waveguide 122 that is in turn fixedly secured, for example, VT furnace brazed to a fabricated copper plunger 124 in turn VT furnace brazed to a stainless steel weld shroud 126. This VT furnace braze fabrication is achieved, for example, in a one or two step furnace braze. The adjustable plunger end assemblies 104 then slip fit into the center sleeve assembly 104 from either end of the center sleeve assembly. A beryllium-copper (Be—Cu) gasket (not shown) can be provided between the sleeve 108 and the plunger 124 to prevent arcing for high power applications.

Figure 6:
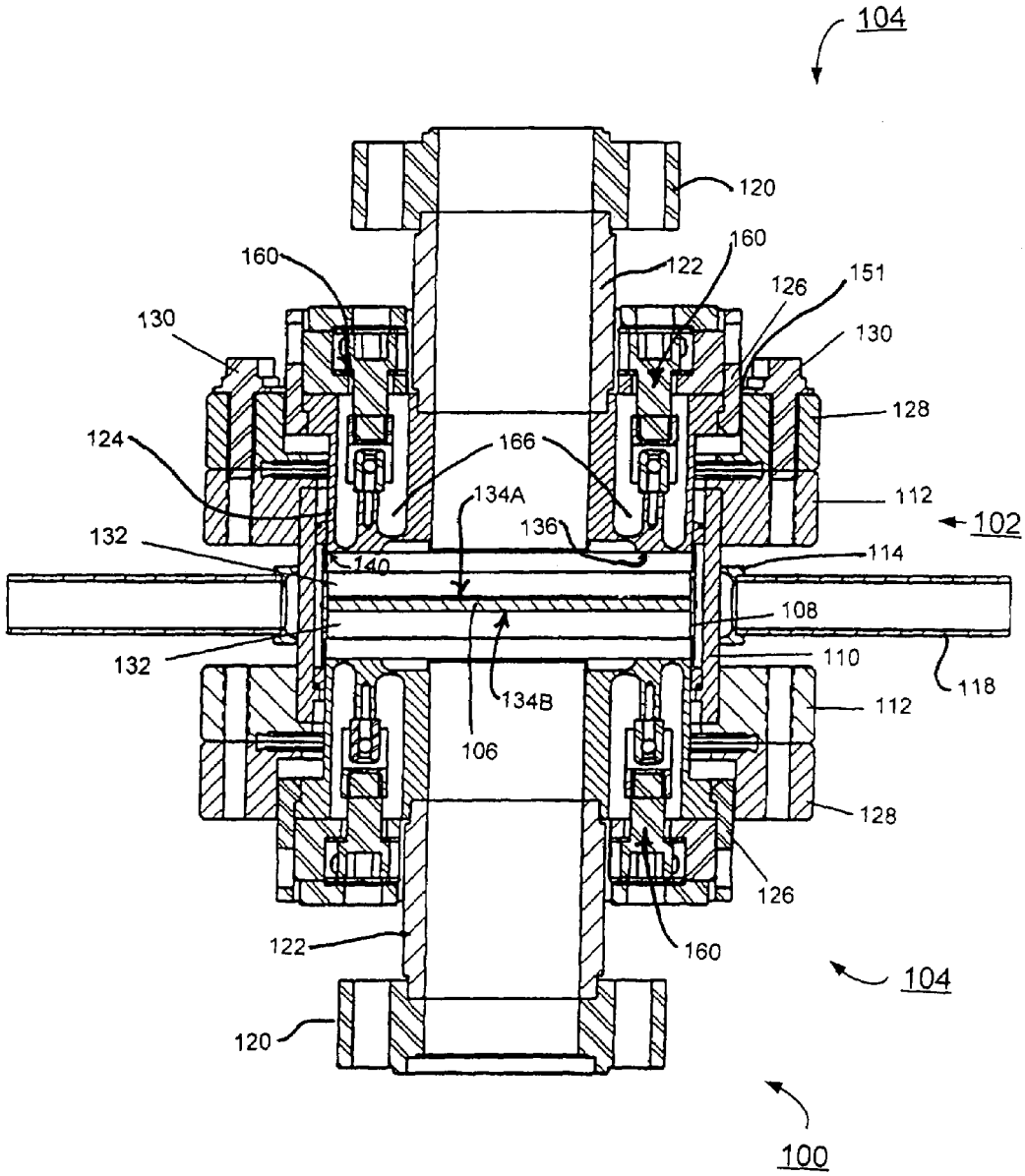
FIG. 6 is a sectional view illustrating the demountable center sleeve assembly of FIGS. 2 and 3 assembled together with a pair of the adjustable plunger end and cavity tuner assemblies of FIGS. 4 and 5 in accordance with the preferred embodiment.
Figure 7:
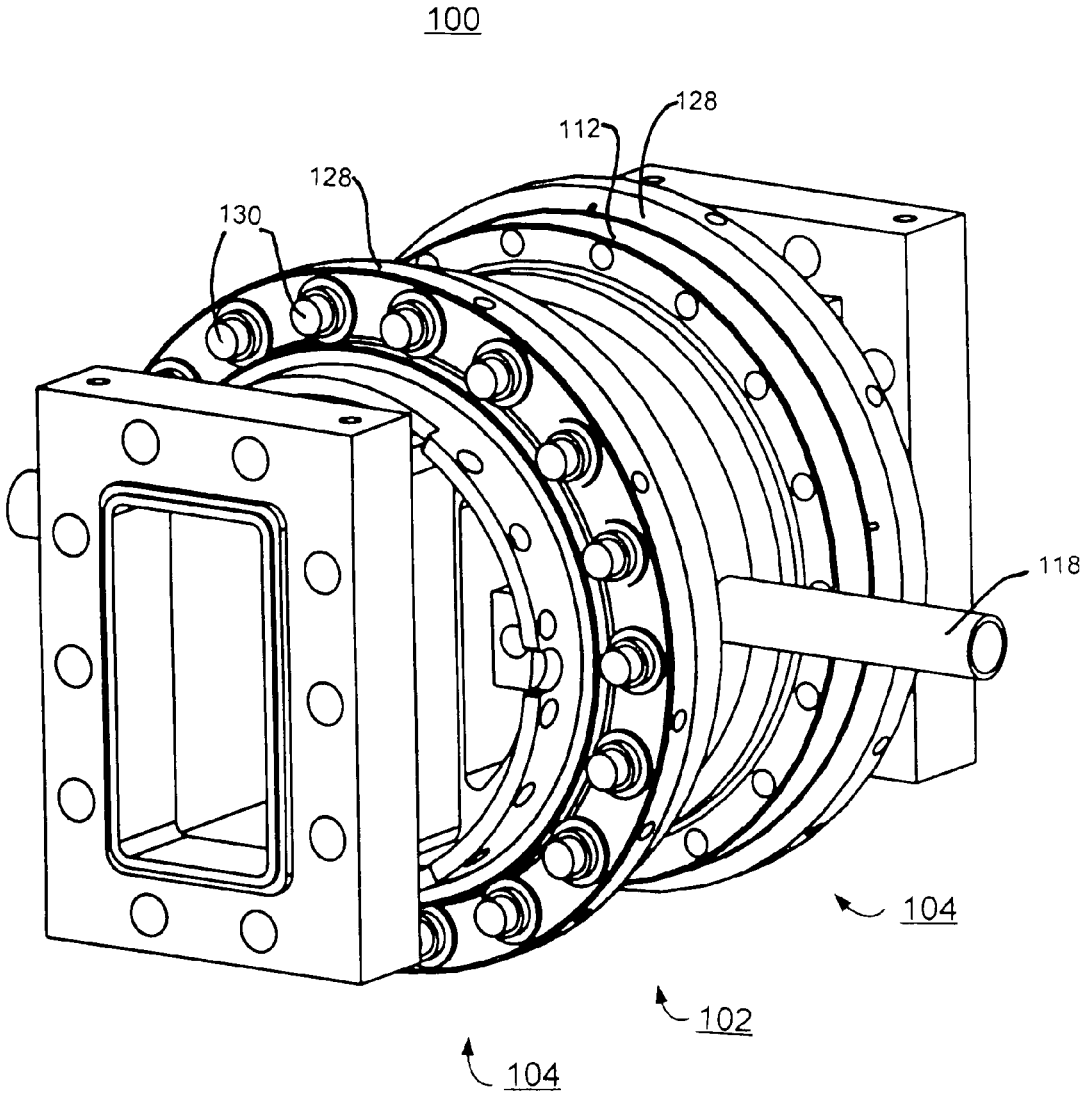
FIG. 7 is a perspective view of the RF window of FIG. 1 in accordance with the preferred embodiment.

Referring now to FIG. 6, to prepare for the assembly process, each center conflat 112 at one end of the center sleeve assembly 102 is removeably fastened to an end conflat 128 through use of bolts 130. A respective adjustable plunger end assembly 104 slip fits into one of the opposed ends of the center sleeve assembly 102, first through one end conflat 128 then through one center conflat 112 and then into the copper sleeve 108. The other adjustable plunger end assembly 104 slip fits into the other opposed end of the center sleeve assembly 102, first through the other end conflat 128 then through the other center conflat 112 and then into the copper sleeve 108. A respective cavity 132 is defined on opposed sides of the ceramic disc 106.

The three subassemblies of the WR340 RF Window 100 are not assembled to become a single VT unit until each adjustable plunger end assembly 104 is TIG welded to its respective end conflat 128 or intermediary ring 128. This TIG weld is performed circumferentially to join the stainless steel weld shroud 126 to the respective end conflat 128 or intermediary ring 128. The invention therefore utilizes a design and process whereby the adjustable plunger end assemblies 104 are not yet welded to their respective end conflat 128 until the cavity width has been adjusted. The thickness of the ceramic disc 106 and the exact internal roundness of the copper sleeve 108 dictate the cavity size needed to achieve 40 dB RF power return loss or better. The RF power return loss is extremely sensitive to the volume of the cavity 132 on either side of the disc 106, to the extent that a fraction of a millimeter change in cavity width can result in the difference between 30 dB RF power return loss less desirable and 40 dB RF power return loss more desirable. It is the precise definition of this cavity width that presents itself as a problem in manufacturing as well as in the design of different size RF windows 100.

The cavity width of each cavity 132 then is defined by the distance from the ceramic disc surface 134A, 134B to a copper plunger face surface 136. The cavity width then is adjustable because the copper plunger 124 is adjustable within the thin walled copper sleeve 108. Since this copper plunger 124 is made to slip fit into the copper sleeve 108, then another factor which influences the RF power return loss is a radial gap 140 between the outer diameter of copper plunger 124 and the inner diameter of copper sleeve 108. This radial gap 140 is controlled, for example, to be less than 0.05 millimeters. The copper sleeve 108 can be machine bored following furnace braze to precise dimensions because the copper sleeve has been adequately reinforced by the stainless steel ring 110. Thus, assembly of this WR340 RF Window 100 further is unique because during the assembly process fine adjustment of the cavity 132 is performed while monitoring the RF power return loss during low power bench testing of the WR340 RF Window 100, using an adjustment fixture illustrated and described with respect to FIG. 8.

Figure 8:
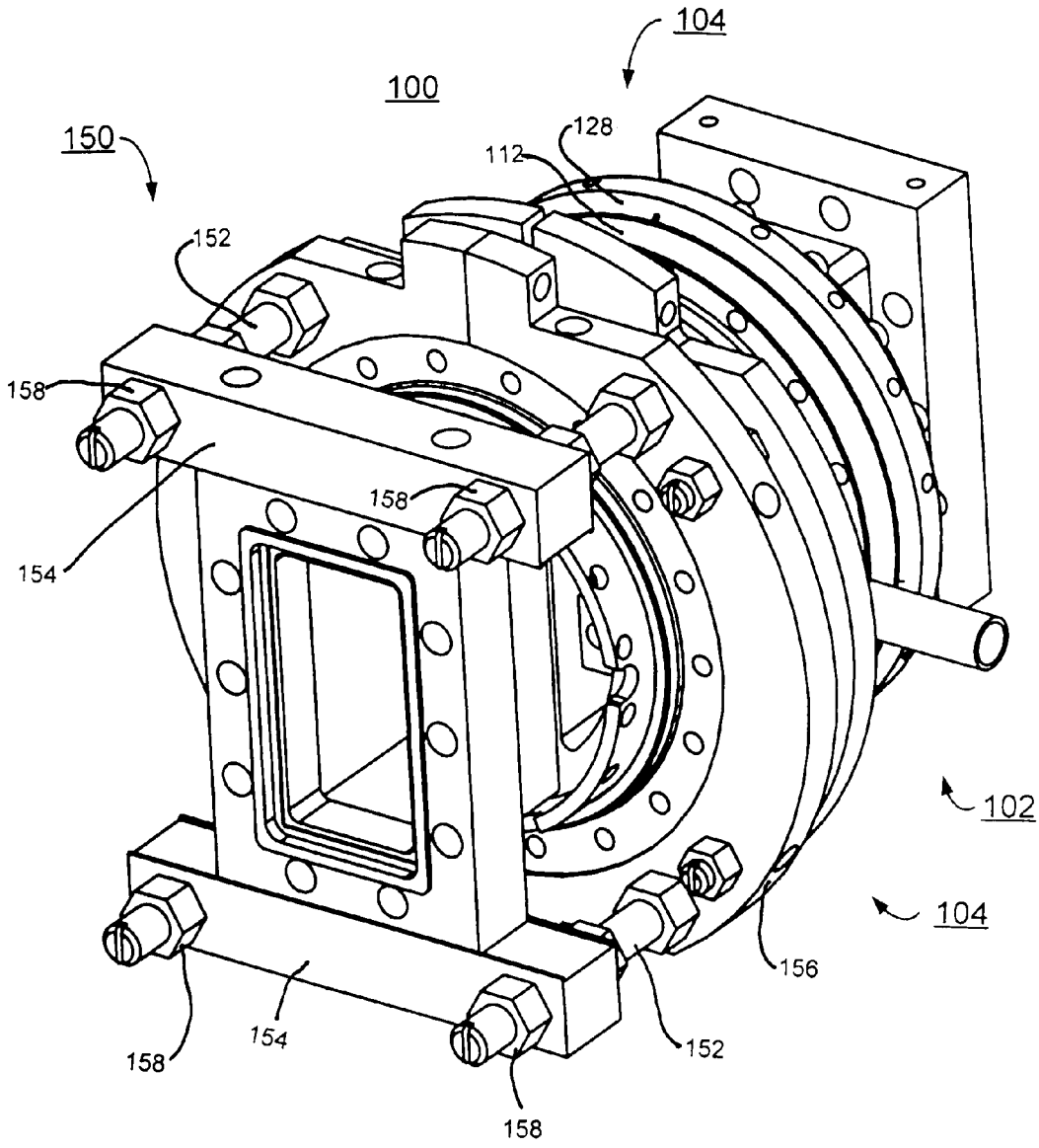
FIG. 8 is a perspective view of the RF window of FIG. 1 together with an adjustment fixture in accordance with the preferred embodiment.

Referring also to FIG. 8, there is shown a plunger end assembly adjustment fixture generally designated by reference character 150, which is used to adjust the plunger 124 into the copper sleeve 108 to prepare for TIG welding of the stainless steel weld shroud 126 to its end conflat 128. The location of this weld is indicated by reference character 151 in FIG. 6. The adjustment fixture 150 secures to the plunger end assembly 104 removeably through a plurality of fasteners 152 at a flange bar 154 and secures to an end conflat 156 remove-ably through the fasteners at the end conflat bars. Adjustments of nuts 158 are used during low power RF bench testing to adjust the cavity volume by adjusting the position of the mating face 136 relative to the particular ceramic surface 134A or 134B. These nuts 158 are securely tightened in preparation for the TIG weld at 151 following proper plunger adjustment. The effect of the TIG weld may be to slightly draw the plunger 124 in toward the particular ceramic face 134A, 134B, minutely decreasing the cavity volume of the cavity 132. This may impact adversely the achieved RF power return loss characteristic. The low power RF bench testing and adjustment fixture process prior to the TIG weld may compensate for this slight volume change by intentionally allowing the final adjustment of the adjustment fixture to be slightly offset in frequency from the frequency of interest. Once the position of the adjustable plunger end assembly 104 into the demountable center sleeve assembly 102 has been optimally determined, the adjustable plunger end assembly 104 is welded to its respective end conflat 128, which has been previously remove-ably attached using bolts 130 to one of the center conflats 112. After TIG welding of each adjustable plunger end assembly 104 to the respective end conflat 128, each adjustable plunger end assembly 104 becomes generally un-adjustable. Since each respective end conflat 128 has been removeably attached or bolted to the demountable center sleeve assembly 102, the fabrication of the WR340 RF Window now awaits only additional finer tuning via a plurality of secondary adjustment cavity tuners 160 of the preferred embodiment.

Referring again to FIGS. 4, 5, and 6, the secondary adjustment cavity tuner 160 allows further finer tuning of the cavity size of cavity 130 even after each adjustable plunger end assembly 104 has been TIG welded to its respective end conflat 128; that is even after the plungers 124 are no longer adjustable. This is achieved via the plurality of cavity tuners 160, each defined by a tuning screw 160 and corresponding hardware secured to the stainless shroud 126 of each adjustable plunger end assembly 104. This cavity tuner hardware consists of two stainless steel members 162, 164 that captivate the tuning screw 160. The back end of the copper plunger has been hollowed 166, leaving a thin wall portion 168 to define the plunger face 136. The tuning screw 160 applies deflection in small increments to the thin plunger face wall 168, thereby distorting the plunger face wall 168, further reducing or increasing the volume of the cavity ever so slightly and further fine tuning the RF power return loss characteristic of the WR340 RF Window 100.

This finer adjustment implemented with secondary adjustment tuning screw 160 is performed by the technician who simultaneously performs the RF bench testing. This further enhances the probability of achieving 40 dB RF power return loss during installation. This entire procedure is thought to be desirable over the traditional method of VT RF window fabrication, which is VT furnace brazing of all pre-machined components to achieve VT joints between copper and stainless components. The furnace braze is usually performed at a location remote from the RF bench test location. Thus, RF power return loss characteristics of the RF window are not traditionally known until after the furnace brazing and assembly of the window is complete, with lesser recourse allowed to improve the RF characteristics. The invention especially improves investigation of new window designs for different size RF windows designed for specific RF signal frequencies, because the adjustability features coordinated with low power RF bench testing reduce the uncertainty incurred when un-adjustable, pre-machined copper and stainless components are not RF bench tested until after the furnace braze is complete.

A feature of this invention is that following fabrication; the demountable center sleeve assembly 102 is detached from the plunger end assemblies 104 and the ceramic surface coatings 134A, 134B are serviced. This is done by unbolting each center conflat 112 from each end conflat 128 effectively unbolting the three WR340 RF Window sub-assemblies 102, 104. Because the adjustable plunger end assembly 104 has been TIG welded to its end conflat 128, no further adjustment of the plungers 124 is possible. However, because the demountable center sleeve sub-assembly 102 has been detached from the two end sub-assemblies 104, its ceramic thin solid cylinder 106 is exposed and can be serviced. This servicing of the ceramic surface coating 134A, 134B becomes necessary for RF windows subjected to high power levels of RF. This demountable feature also allows investigating different ceramic coatings for newly designed RF windows.

While the present invention has been described with reference to the details of the embodiments of the invention shown in the drawing, these details are not intended to limit the scope of the invention as claimed in the appended claims.

What is claimed is:

1. An RF window for use in a waveguide comprising:

a center sleeve assembly including a ceramic disc mounted within a copper sleeve;

said ceramic disc having opposed surfaces and a ceramic surface coating being applied to each of the opposed surfaces;

said ceramic surface coatings being selected for a particular application of the RF window;

a pair of end assemblies removably assembled with said center sleeve assembly; and each said end assembly including an adjustable plunger end assembly; said adjustable plunger end assembly including an intermediary ring for removable assembly with said center sleeve assembly and a mating face; said mating face being arranged for adjustable slip fit engagement within said copper sleeve of the center sleeve assembly to define a respective cavity on opposed sides of the ceramic disc with said mating face being positioned to an adjusted position; and said intermediary ring being fixedly secured to said end assembly with said mating face at said adjusted position.

2. An RF window as recited in claim 1 wherein said ceramic disc is vacuum tight furnace brazed to said copper sleeve.

3. An RF window as recited in claim 2 further includes a support ring for reinforcing said copper sleeve and wherein said copper sleeve is vacuum tight furnace brazed to said support ring.

4. An RF window as recited in claim 3 wherein said support ring is formed of stainless steel.

5. An RF window as recited in claim 3 wherein said center sleeve assembly includes a pair of opposed conflats fixedly secured to said support ring; each of said conflats respectively removably assembled with said intermediary ring of each said end assembly.

6. An RF window as recited in claim 5 wherein said opposed conflats are welded to said support ring.

7. An RF window as recited in claim 5 wherein said intermediary ring of each said end assembly is an end conflat; said respective end conflat of said end assemblies being bolted to said opposed conflats of said center sleeve assembly.

8. An RF window as recited in claim 7 wherein RF bench testing is performed to locate said mating face at said adjusted position with a predetermined reflection response.

9. An RF window as recited in claim 1 wherein each said end assembly includes a secondary adjustment tuning screw for deflecting said mating face of each end assembly for secondary adjustment of each said respective cavity on opposed sides of said ceramic disc.

10. An RF window as recited in claim 1 wherein each said end assembly includes a pair of tuning screws, each for deflecting said mating face of each end assembly for secondary adjustment of said respective cavity on opposed sides of said ceramic disc.

11. An RF window as recited in claim 1 wherein said mating face of each end assembly includes a thin copper wall.

12. An RF window as recited in claim 1 wherein said ceramic disc is formed of aluminum oxide ceramic material.

13. An RF window as recited in claim 1 wherein said ceramic surface coating includes a selected material having a low secondary electron emission coefficient.

14. An RF window as recited in claim 1 wherein said ceramic surface coating material includes a selected material from a group of materials including Titanium Nitride ($TiN_2$).

15. A method of manufacture of the RF window comprising the steps of:

providing a center sleeve assembly including a ceramic disc mounted within a copper sleeve; said ceramic disc having opposed surfaces and a ceramic surface coating being applied to each of the opposed surfaces; said ceramic surface coatings being selected for a particular application of the RF window;

removably assembling a pair of end assemblies with said center sleeve assembly including for each respective end assembly the steps of:

slidingly inserting an end assembly mating face portion within the copper sleeve of the center sleeve assembly to form a subassembly; each said mating face portion and one said ceramic disc surface defining a respective cavity on the opposed sides of the ceramic disc;

RF bench testing said subassembly and adjusting a position of said end assembly mating face portion within the copper sleeve to define a predetermined reflection response;

fixedly securing an intermediary ring to said end assembly responsive to said adjusted position;

securing said end assembly to said center sleeve assembly; and selectively adjusting at least one secondary adjustment tuning screw for deflecting said mating face portion to compensate for a change in said predetermined reflection response resulting from the securing steps.

16. A method as recited in claim 15 wherein the step of providing said center sleeve assembly including said ceramic surface coatings being selected for a particular application of the RF window includes the steps of providing said ceramic surface coating of a selected material having a low secondary electron emission coefficient.

17. A method as recited in claim 15 further includes the steps after the RF window has been subjected to a high power level of detaching said center sleeve assembly from the end assemblies to expose said ceramic disc.

18. A method as recited in claim 17 further includes the steps of servicing said ceramic surface coatings.

19. A method as recited in claim 17 further includes the steps of applying a selected ceramic surface coating material to one or both of the opposed surfaces of said ceramic disc.

* * * * *